United States Patent [19]

van der Sloot et al.

[11] 4,454,685

[45] Jun. 19, 1984

[54] VEHICLE DOOR CONSTRUCTION

[75] Inventors: Bart van der Sloot, Weidum; Sijtse Epema, Giekerk, both of Netherlands

[73] Assignee: Tebel Machinefabrieken B.V., Netherlands

[21] Appl. No.: 269,893

[22] Filed: Jun. 3, 1981

Related U.S. Application Data

[63] Continuation-in-part of Ser. No. 50,339, Jun. 20, 1979, abandoned.

[51] Int. Cl.[3] ..... E05C 7/06

[52] U.S. Cl. ..... 49/110; 49/139; 49/340

[58] Field of Search ..... 49/110, 280, 108, 139, 49/340

[56] References Cited

U.S. PATENT DOCUMENTS

| | | | |
|---|---|---|---|
| 2,419,964 | 5/1947 | Newkirk | 49/280 X |
| 2,893,506 | 7/1959 | Daugirdas | 49/110 X |
| 3,104,098 | 9/1963 | Daugirdas | 49/280 X |
| 3,537,403 | 11/1970 | Daugirdas | 105/341 |

FOREIGN PATENT DOCUMENTS

| | | | |
|---|---|---|---|
| 1260345 | 2/1968 | Fed. Rep. of Germany | 49/110 |
| 318747 | 1/1957 | Switzerland | 49/110 |
| 1546266 | 7/1970 | United Kingdom . | |

*Primary Examiner*—Kenneth Downey

*Attorney, Agent, or Firm*—Scully, Scott, Murphy & Presser

[57] ABSTRACT

A door construction for a vehicle, in particular a railway carriage, comprising a one-leaved or two-leaved door which through the intermediary of one or more brackets, secured to a rotatable, vertical shaft, can be opened or closed by rotating said shaft, and a drive means for rotating said rotatable shaft, which drive means acts through the intermediary of a linkage on a first arm secured to said rotatable shaft, and by means of which the door can be locked in the closed position. In the closed position of the door, the linkage can be locked in a single point according to the overcenter closing principle.

5 Claims, 4 Drawing Figures

VEHICLE DOOR CONSTRUCTION

This is a continuation-in-part of application Ser. No. 050,339, filed June 20, 1979, now abandoned.

BACKGROUND OF THE INVENTION

1. Field of the Invention

The present invention relates generally to a door construction for a vehicle, in particular to a door construction designed for a railway carriage.

2. Discussion of the Prior Art

A prior door construction of this kind comprises a one-leaved or two-leaved door, which through the intermediary of one or more brackets, secured to a rotatable, vertical shaft, can be opened or closed by rotating the shaft, and a drive means for rotating the rotatable shaft, which drive means acts through the intermediary of a linkage on a first arm secured to the rotatable shaft, and by means of which the door can be locked in its closed position.

Such a door construction is described in Dutch patent specification no. 122,533 in which the movement for opening and closing of the door or doors is obtained by means of a pneumatic cylinder. The linkage comprises an intermediate rod pivoted at one end to the arm, and at the other to a guide rod having a fixed pivot at its other end. The object of this linkage is to lock the door in its closed position, for which purpose, among other things, the intermediate rod is made shorter than the guide rod and the relative positions thereof are such that, in the closed position, the intermediate rod and the guide rod overlap each other, and thereby occupy a dead-center position relative to each other for locking purposes.

The prior door construction is also applicable to a two-leaved door. In the case of a two-leaved door, the intermediate rods are pivoted together at their ends by means of a single, rigid connecting rod, with the fixed pivots of the guide rods being arranged on opposite sides of the connecting rod, and the pneumatic cylinder acting on said connecting rod.

In the prior door construction, the number of pivots is considerable, namely ten in the case of a two-leaved door. In addition, the prior door construction does not offer the possibility, for example, in the case of failure of the central pneumatic system which operates the pneumatic cylinder, of manually opening the doors both from the inside and from the outside, at least not in a structurally simple manner.

SUMMARY OF THE INVENTION

It is an object of the present invention to provide an improved door construction which has a considerably smaller number of pivots requiring maintenance than prior art arrangements, and if desired can be provided with a construction for manual emergency operation of the doors.

The invention is characterized in that, in the closed position of the one-leaved or two-leaved door, the linkage can be locked in a single point according to the overcenter closing principle.

In this connection the door construction according to the present invention, in which a drive means acts on a first arm in a first pivot thereof via a connecting rod forming part of the linkage, is arranged so that the drive means pivotally engages with the connecting rod in a second pivot thereof through the intermediary of a second arm having a fixed pivot.

When a compressed-air-operated cylinder is utilized as the means for imparting opening and closing movements to the doors, in a preferred embodiment of the door construction according to the present invention, the compressed-air-operated cylinder is a rotary cylinder, the turning shaft of which is fixedly connected to the second arm.

BRIEF DESCRIPTION OF THE DRAWINGS

The invention will now be elucidated in more detail with reference to the accompanying drawings, in which identical reference numerals refer to like elements throughout the several views.

DETAILED DESCRIPTION OF THE DRAWINGS

Figure 1:
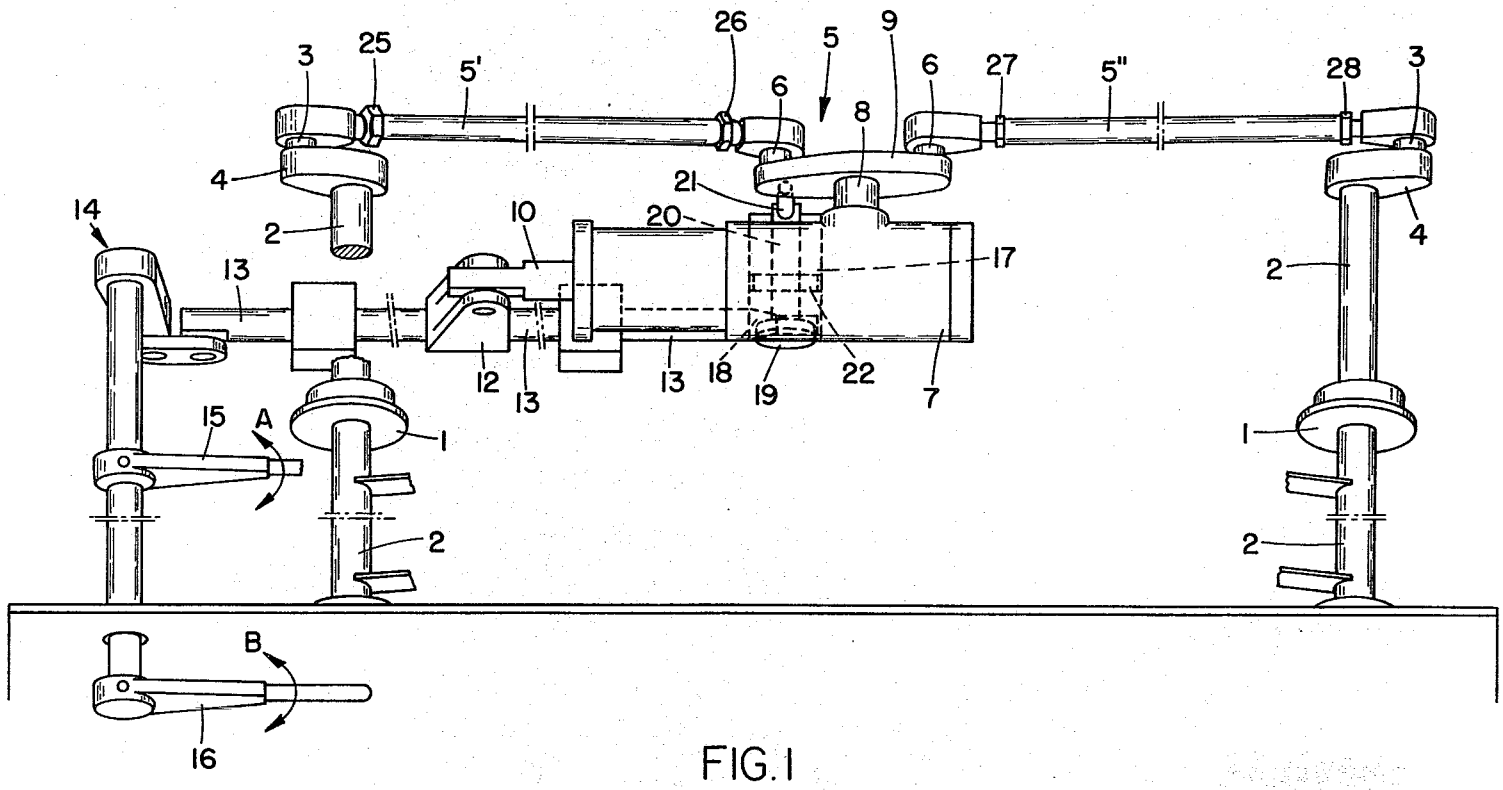
FIG. 1 illustrates a diagrammatic, perspective view of a preferred exemplary embodiment of the linkage connections of a door construction according to the present invention.
Figure 2:
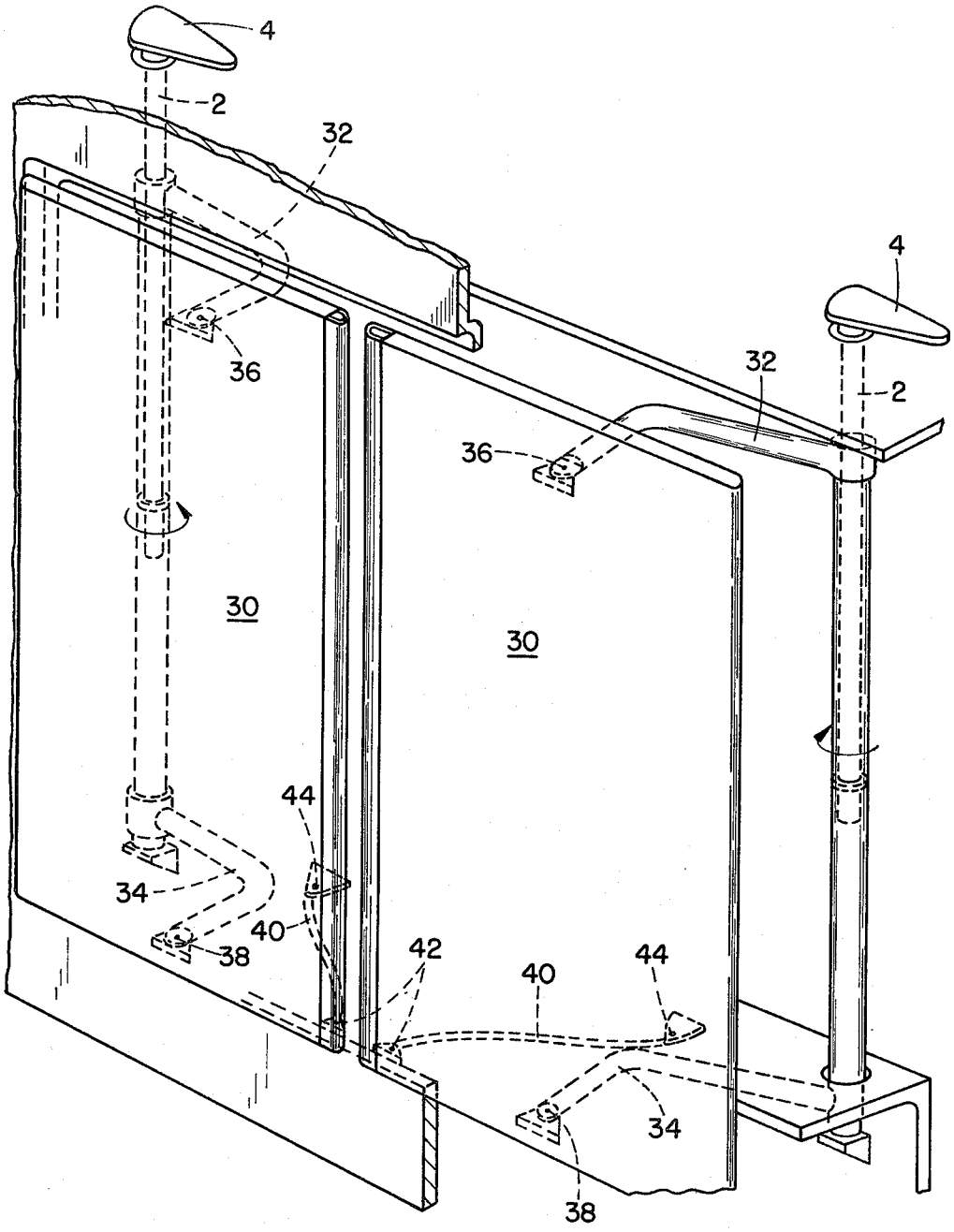
FIG. 2 illustrates a two-leaved swing plug door as it is coupled to the linkage connectors of FIG. 1.

In the drawing, which relates to a door construction comprising a two-leaved swing plug door, in the closed position, i.e. a left-hand leaf and a right-hand leaf symmetrical therewith, there is shown a bearing 1 journalling a vertical shaft 2, from which the door leaves are suspended by means of brackets shown in greater detail in FIG. 2. The rotatable vertical shafts 2 normally terminate in the roof and floor sections of the railway carriage vehicle as illustrated in greater detail in FIG. 2. Secured at the top end of shaft 2 is a first arm 4, the other end of which is pivoted in a first pivot 3 to a connecting rod member 5' and 5'', respectively, forming a divided connecting rod 5.

Drive means 7 is a so-called rotary cylinder, by means of which the movement of a pneumatically reciprocating piston rod is converted by the rack-and-pinion principle into a rotary movement of a rotary shaft, designated in the drawing by 8. Fixedly connected to shaft 8 is a second arm 9, with the connecting rod members 5' and 5'' of the divided connecting rod 5 respectively engaging with the second arm 9 in two second pivots 6. As the door is being closed, the closed position is reached when the connecting rod members 5' and 5'' are in alignment with each other, and have a dead-center position relative to each other. The closing force of the door thus has reached a maximum too. The rotary movement which shaft 8 receives from the cylinder, however, has been adjusted so that the second pivots are forced beyond the dead-center position, whereby there is obtained a fully assured safelocking in the closed position, i.e. one which offers security even when subject to vibrations or other, greatly varying loads acting on the door construction.

In the embodiment shown in the drawings, the connecting rod members 5' and 5'' are themselves constituted by parts interconnected by means of screwthread connections 25, 26 and 27, 28, respectively. This offers the possibility for the linkage to be given an optimum adjustment with regard to the closing force of the doors when the connecting rod members 5' and 5'' are in the dead-center position, and the extent to which the second pivots 6 are forced beyond the dead-center position.

The embodiment shown in the drawings, in which the drive means from which the movement for opening and closing the doors is derived is a rotary cylinder, has the advantage of providing a readily accessible point of engagement for an emergency operation of the door construction for use in case, for example in the event of failure of the central compressed-air system, or for any other reason. A particular door must be capable of being opened or closed manually from within or without the vehicle. For this purpose the piston rod of the rotary cylinder has been extended to project from the cylinder housing, and the external piston rod portion 10 is fixedly connected via arm 12 to an axially movable rod 13.

Rod 13 is engaged by a linkage 14, which comprises a handle 15 and 16, respectively located on the inside and on the outside of the vehicle. By moving handles 15, 16 in the direction of arrows A and B the piston rod of cylinder 7 can manually be given a reciprocating movement from within and from without the vehicle, to open or close the door. In order that the muscular power required for manually opening the door may be kept relatively small, for example, less than 25 kg, there is provided an auxiliary linkage 17, which is also engaged by rod 13.

A run-on surface 18 is provided on rod 13, and cooperates with a roller 19 upon manual operation of linkage 14 to open the door. The thus caused axial displacement of rod 13 effects a pivoting movement of lever 20 about shaft 22 to press against hold-down pin 21, which is in contact with the left-hand over-center closing system, as shown in the drawing. This facilitates release of the over-center closing system during opening of the door.

As shown in the drawings, the door construction shown for a two-leaf swing plug door comprises only four pivots.

The alignment of the linkage in the door construction according to the invention is non-critical, so that the ball-and-socket joints can be used for the various pivots.

Referring to FIG. 2, reference numeral 30 designates the two door leaves, connected through the intermediary of upper brackets 32 and lower brackets 34 to the rotatable shafts 2. The connection of the brackets to the door leaves is by means of pivots 36 and 38.

Aside from the brackets 32 and 34, each door-leaf pivotally engages a rod 40 at 42, which rods 40 have a fixed rotation center at 44 in such a way that a pivotable parallelogram is formed so that the door-leaves undergo a parallel displacement during opening and closing.

Figure 3:
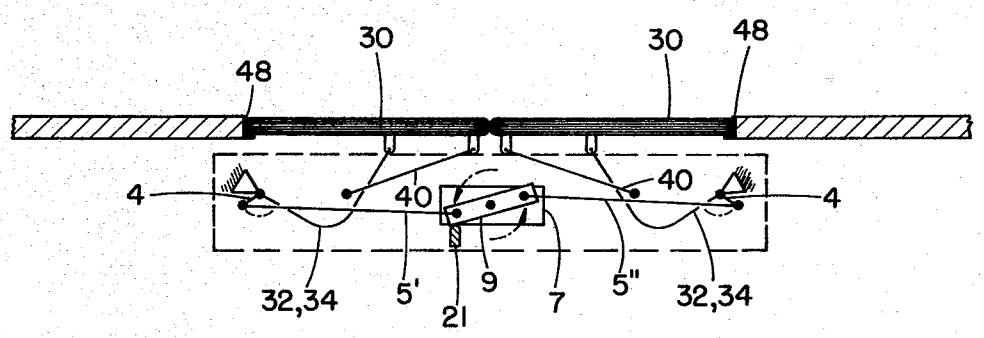
FIG. 3 and 4 illustrates the two-leaved swing plug door, with its several linkage connectors, respectively in its closed and open positions.
Figure 4:
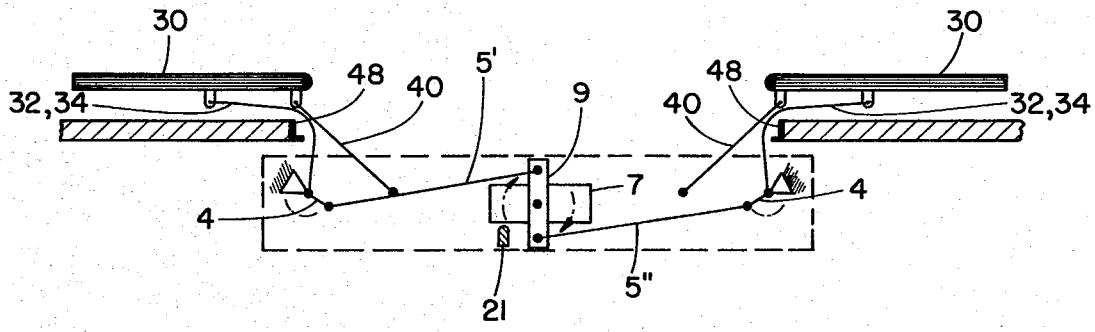

As further clarification of the operation of the disclosed embodiment, the two leaved swing plug door, and its several linkage connectors, is illustrated in FIGS. 3 and 4 respectively in its closed and open positions.

Proceding from an open to a closed position, the door leaves 30 (if a two-leaved door is taken as an example) after being plugged into the door opening are initially moved slightly further beyond the door plane in the direction towards the inside of the carriage until the overcenter closing position is reached. Thereafter the closed and overcenter blocked door leaves move back as a rigid unit into the door plane under the influence of a spring tension while closing the door opening. Such spring tension should be available, for if the door construction system is completely rigid, the overcenter blocking system will not normally operate satisfactorily. With swing-plug doors, this spring effect can be attained by means of the normally present rubber anti-draft sealing strips 48 positioned along the vertical side edges of the door leaves contacting each other in the closed door position and of the corresponding vertical edges of the door casing of the carriage.

Naturally, the door construction described above and shown in the accompanying drawings can be modified without departing from the scope of the present invention.

The embodiment shown in the drawings, incorporating two separate second pivots 6, is preferred to a construction in which the connecting rod members 5' and 5'' have one common second pivot 6, among other reasons for being lower in height, allowing for the connecting rod members to be of similar construction (equal length) and, in particular, the construction being balanced as the reaction forces in the two connecting rod members neutralize each other.

What is claimed is:

1. A door construction for a vehicle, comprising a one-leaved or two-leaved door of the swing-plug type which through the intermediary of one or more brackets, secured to a rotatable, vertical shaft, the ends of which are connected to the floor and roof sections of the carriage, can be opened or closed by rotating said shaft, a drive means for rotating said rotatable shaft, which drive means acts via a connecting rod forming part of a linkage in a first pivot thereof on a first arm secured to said rotatable shaft, and by means of which drive means the door can be locked in a closed position, characterized in that, said drive means has a turning shaft (8) fixedly connected to a second arm (9) which is pivotally connected to said connecting rod (5) in a second pivot (6) thereof, said linkage in a single point in the closed position of the one-leaved or two-leaved door being locked according to the overcenter closing principle by means of a stop means (21) limiting rotation of the second arm (9), and said door being resiliently movable in the plane of the door opening by having at least one sealing strip along a vertical side edge which provides a limited resilient force in the plane of the door opening for biasing said second arm against said stop means for overcenter locking of the door.

2. A door construction according to claim 1, comprising a two-leaved door in which the two first arms are coupled together in the first pivots thereof by said connecting rod, characterized in that said connecting rod is a divided rod whose ends remote from the first arms (4) in the first pivots (3) are pivoted to the second arm (9) in two pivots (6).

3. A door construction according to claim 1 or 2, characterized in that the distance between the first pivot (3) and the second pivot (6) is adjustable within given limits.

4. A door construction according to claim 5 or 6, in which said drive means comprises a compressed air operated rotary cylinder (7) having said turning shaft (8) as a component thereof.

5. A door construction according to claim 4, characterized in that the rotary cylinder (7) has an external piston rod portion (10) located outside the cylinder housing, said external piston rod portion being acted upon by a linkage by means of which the axial displacement of the piston rod can be performed manually from within or without the vehicle.

* * * * *

UNITED STATES PATENT OFFICE

CERTIFICATE OF CORRECTION

Patent No. 4,454,685 Dated June 19, 1984

Inventor(s) Bart Vander Sloot, et al.

It is certified that error appears in the above-identified patent and that said Letters Patent are hereby corrected as shown below:

Claim 4, "5 or 6" should be --1 or 2--.

Signed and Sealed this

*Thirteenth* Day of *November 1984*

[SEAL]

*Attest:*

GERALD J. MOSSINGHOFF

*Attesting Officer*

*Commissioner of Patents and Trademarks*